United States Patent [19]

Schellenberg et al.

[11] Patent Number: 5,026,211

[45] Date of Patent: Jun. 25, 1991

[54] WATER-BASED CORRECTIONAL FACILITY AND SYSTEM, AND METHOD OF MAKING THE SAME

[75] Inventors: Victor R. Schellenberg, Hampton; James Zsoldos, Grafton; Joy L. Hartman, Chesapeake, all of Va.; William H. Smith, deceased, late of Newport News, Va., by Monteen B. Smith, executor; Wilbur T. Covington, Grafton; Allen Conley, Tabb, both of Va.

[73] Assignee: Newport News Shipbuilding and Dry Dock Company, Newport News, Va.

[21] Appl. No.: 247,608

[22] Filed: Sep. 22, 1988

[51] Int. Cl.[5] ..... E02B 17/00; E04H 3/08

[52] U.S. Cl. ..... 405/204; 52/106; 114/264; 405/205

[58] Field of Search ..... 405/195, 204, 217, 227, 405/205; 114/264, 64 R; 52/106, 79.1

[56] References Cited

U.S. PATENT DOCUMENTS

| | | | |
|---|---|---|---|
| 3,978,807 | 9/1976 | Nitzki | 114/264 |
| 4,501,098 | 2/1985 | Gregory | 52/79.1 |
| 4,575,281 | 3/1986 | Oksuzler | 405/204 X |
| 4,599,829 | 7/1986 | DiMartino, Sr. | 52/106 X |
| 4,648,749 | 3/1987 | Ferguson | 405/217 X |
| 4,658,747 | 4/1987 | Frenz et al. | 52/79.1 X |
| 4,659,255 | 4/1987 | Shiraishi et al. | 405/216 |
| 4,732,103 | 3/1988 | Culbertson | 114/65 R |

FOREIGN PATENT DOCUMENTS

| | | | |
|---|---|---|---|
| 40989 | 4/1978 | Japan | 114/264 |
| 55990 | 5/1979 | Japan | 114/264 |
| 140395 | 10/1979 | Japan | 114/264 |
| 175197 | 8/1986 | Japan | 114/264 |
| 1431670 | 4/1976 | United Kingdom . | |

OTHER PUBLICATIONS

*Shipping World & Shipbuilder*, May 1988, "A Use for VLCCs".

*Primary Examiner*—Dennis L. Taylor
*Assistant Examiner*—Arlen L. Olsen
*Attorney, Agent, or Firm*—Lalos & Keegan

[57] ABSTRACT

The present invention is directed to a water-based correctional facility, a water-based correctional system including a ship or ship hull converted into a water-based correctional facility and a method of converting a ship or ship hull into the correctional facility or system. Preferably, the correctional system includes a water-based pier and vehicular bridge. The correctional facility includes all the features and capabilities of a typical land-based correctional facility.

47 Claims, 7 Drawing Sheets

WATER-BASED CORRECTIONAL FACILITY AND SYSTEM, AND METHOD OF MAKING THE SAME

BACKGROUND OF THE INVENTION

The present invention is directed to a water-based correctional facility, a water-based correctional system, and method of making the same. More specifically, a water-based correctional facility can be constructed of a new or used ship hull or ship, which is placed in contact with the bottom of a body of water at a preselected site. The body of water would generally be a lake, river, port, bay or sea, preferably located near a major metropolitan center, or in an accessible location near land.

The planning and construction of land-based correctional facilities have in the past been plagued with a number of problems. For example, obtaining land for such use is expensive and requires long-term planning and implementation due to the legal and political hurdles that must be overcome. Seeking the placement of a correctional facility within a community requires county planning, re-zoning consistent with the county ordinances and master zoning plan, and will often result in a referendum submitted to the voters living near the proposed construction site. These requirements result in some degree of unpredictability whether or not a correctional facility will ever be approved within the community. The placement of correctional facilities on a state level again involves many legal and political issues and problems. Correctional facilities provide many jobs and constituents around the state continuously vie for placement of such job-generating facilities within their communities.

It may be desirable to place correctional facilities near a location where criminal activity is the highest within a state to facilitate legal processing of criminals, minimize the substantial costs incurred in transporting prisoners around the state, provide the benefits of not dislocating the prisoner from his or her community or family, etc. Generally, major metropolitan areas are the centers of criminal activity, especially hardened criminal activity such as drug dealing, armed robbery, rape, murder and other violent crimes typically associated with hardened criminals that end up with sentences that require placement in a correctional facility. The result is that most major correctional facilities, especially for hardened criminals, are placed substantially distant from the centers of criminal activity since land is expensive and unavailable at or near major metropolitan areas, and the legal and political issues and problems are exponential as the facility is placed closer to the center of the metropolitan area.

The ideal situation would be placement of correctional facilities within major metropolitan areas to facilitate the legal processing of criminals and to reduce the cost and time of transportation between courts in the metropolitan area, which typically try and process criminals for crimes that occur within the metropolitan area. Further, major metropolitan areas provide a large employment force that is readily available for operating the facility.

A water-based correctional facility placed along the waterfront at or near a major metropolitan area provides numerous benefits over a land-based correctional facility in that the land under these bodies of waters is typically already owned by the state, the land is already available requiring no razing of existing structures, requires no re-zoning of existing parcels, and can be prepared for receiving the correctional facility relatively inexpensively compared with the costs of constructing a foundation for a land-based correctional facility. Further, the downtown sections of many metropolitan areas are edged by waterfront providing excellent access to courts located downtown with the benefit of a large downtown police force to ensure security and prevent successful escapes from the facility.

At this time, there have been a number of proposals for converting ferries, barges, and other relatively small watercraft into temporary restraining or short-term jail facilities. The type of security provided on these proposed converted watercraft is minimal and is generally for use with prisoners awaiting trial or soon to be released prisoners completing relatively short terms for less severe offenses.

The present invention is directed to a correctional facility that is water-based or supported on the bottom of a body of water. The term "correctional facility" is used to describe a high-security, long-term prison substantially self-contained with a warden and full-time staff for incarcerating prisoners for substantially long prison terms such as one year to life. The facility includes large dining facilities for feeding the staff and prisoners, hospital facilities, counseling facilities, recreational facilities (indoor and outdoor), work areas for manufacturing articles for the state, one or more high-security peripheral walls, fences or other restraining means, guard towers for maintaining high security along the perimeter restraining means, and other necessary features of conventional land-based correctional facilities.

The features and requirements of a water-based correctional facility are substantially different from those of the proposed short-term jail facilities. For example, the water-based correctional facility must be substantially more stable and prevented from movement due to currents, tides, winds and other physical forces in order to ensure safety, high security and to prevent seasickness of persons on the facility. Some of the proposed short-term jail facilities appear to be floating or temporarily partly beached on shore.

The correctional facility of the present invention includes a hull placed in contact with the bottom of the body of water in which the facility is disposed to provide a foundation and to assure no movement of the correctional facility during its lifetime, unless so desired. Thus, once the hull of the correctional facility is set in place, the correctional facility is supported soundly in a manner similar to a land-based correctional facility.

The correctional system of the present invention utilizes a converted ship or ship hull. Preferably, the correctional system includes a pier positioned adjacent the hull of the correctional facility. The pier can be located near or on land, but is preferably water-based to provide a moat effect around the correctional facility/-pier combination and the waterfront. A vehicular bridge connects the water-based pier to the land at the waterfront. The pier provides a means for loading staff, prisoners, supplies, etc., onto and off the correctional facility, and parking and storage space for operation of the facility. The vehicular bridge restricts pedestrian or vehicle access between the facility and land for providing another measure of security.

Many major highway and interstate systems include sections that pass along waterfronts of metropolitan areas. The present correctional system preferably includes connecting the correctional facility via the vehicular bridge by a ramp into such highway or interstate systems for facilitating transportation to and from the correctional facility. Thus, escorted prisoners and staff are provided with easy access between areas located near the metropolitan area, such as local suburbs, or distant from the correctional facility. Since correctional facilities are limited in number for each state, typically prisoners from a region or regions of a state are transported substantial distances to the regional correctional facility once being sentenced. Further, this type of access to the correctional facility provides additional security for transporting prisoners by further limiting and restricting prisoner contact with the general public during transportation via interstate highways, rather than by ordinary roads and city streets.

Preferably, a used ship would serve as the basis for the invention. At the present time, used ship hulls are readily available at relatively low cost because of a presently existing depressed oil and/or gas tanker market. The present world-wide glut of oil has resulted in substantially less intercoastal shipping of oil and gas.

The construction of correctional facilities is constrained by various government and agency standards to provide a reasonable living condition for the prisoners. An important aspect includes the amount of light exposure that each prison cell receives, and requirements on outdoor and indoor recreational areas and exposure time. The correctional facility of the present invention provides sufficient light to a multiplicity of prison cells by locating these prison cells above a main level. Also, by placing the multiplicity of prison cells above the main level and restricting access below the main level, a measure of high security is provided.

Generally, a majority of the life-sustaining needs of food, water, medical care, etc., are located below the main level or can be controlled from below the main level so as to isolate prisoners located above the main level from these life-sustaining needs to prevent a long-term prison holdout or riot. Further, an escape route by prisoners from the multiplicity of prison cells located above the main deck is substantially inhibited due to the main level being located a substantial distance above the level of the water. To further inhibit escape from the main level, the multiplicity of prison cells are encompassed by a perimeter security means such as two perimeter, high-security fences one located within the other. Elevated guard towers are preferably provided to enhance the security of the perimeter security means.

The present invention includes a method of converting an existing ship or ship hull into the correctional facility. In the event that a existing ship hull is utilized to construct the correctional facility, less modification is needed because there is no superstructure to be removed from the ship as would be necessary in the conversion of a completed ship.

Most of the ships contemplated for conversion into the correctional facility of the present invention have cambered steel main deck portions at positions other than where superstructure exists. For example, a conventional oil tanker includes a superstructure with a large steel cambered deck located forward of the superstructure extending to the stem of the ship. This main deck portion is cambered so that water that reaches the main deck of the oil tanker in heavy seas is quickly drained to prevent the ship from becoming top heavy and unstable for any substantial duration of time. Thus, the conversion of an oil tanker into the present correctional facility requires the conversion of the main deck of the ship by removing machinery and superstructure located on or above the main deck and by removing the cambered steel deck or providing means for leveling the cambered steel deck to achieve a substantially flat main level. The multiplicity of prison cells are then constructed on or above the flat main level.

SUMMARY OF THE INVENTION

An object of the present invention is to provide a water-based correctional facility.

Another object of the present invention is to provide a water-based correctional facility constructed from a ship hull in contact with the bottom of a body of water and having a main level supported on the hull with a multiplicity of prison cells located above the main level, and a perimeter security means encompassing the prison cells.

Another object of the present invention is to provide a water-based correctional facility having a multiplicity of prison cells located above a main level for providing adequate exposure to light and the surrounding environment.

A further object of the present invention includes providing a correctional facility having a multiplicity of prison cells located above a main level with a perimeter security means encompassing the multiplicity of prison cells for providing a high security correctional facility.

A still further object of the present invention is to provide a water-based correctional facility having flat and level portions on a main level by providing leveling means over a cambered steel deck.

An object of the present invention is to provide a water-based correctional system.

Another object of the present invention is to provide a water-based correctional system including a water-based correctional facility having the same or similar features of a land-based correctional facility with a land-based or water-based pier positioned adjacent thereto.

A further object of the present invention is to provide a water-based correctional system including a water-based correctional facility positioned adjacent a water-based pier with a vehicular bridge connecting the water-based pier to land.

An object of the present invention includes converting a ship or ship hull into a water-based correctional facility or system.

A further object of the present invention includes converting a ship having a cambered steel main deck portion into a correctional facility or system including a flat main level by providing leveling means.

Another object of the present invention includes converting a ship or ship hull into a water-based correctional facility by converting the main deck of the ship or ship hull into a flat main level on which a multiplicity of prison cells are constructed and supported thereon.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
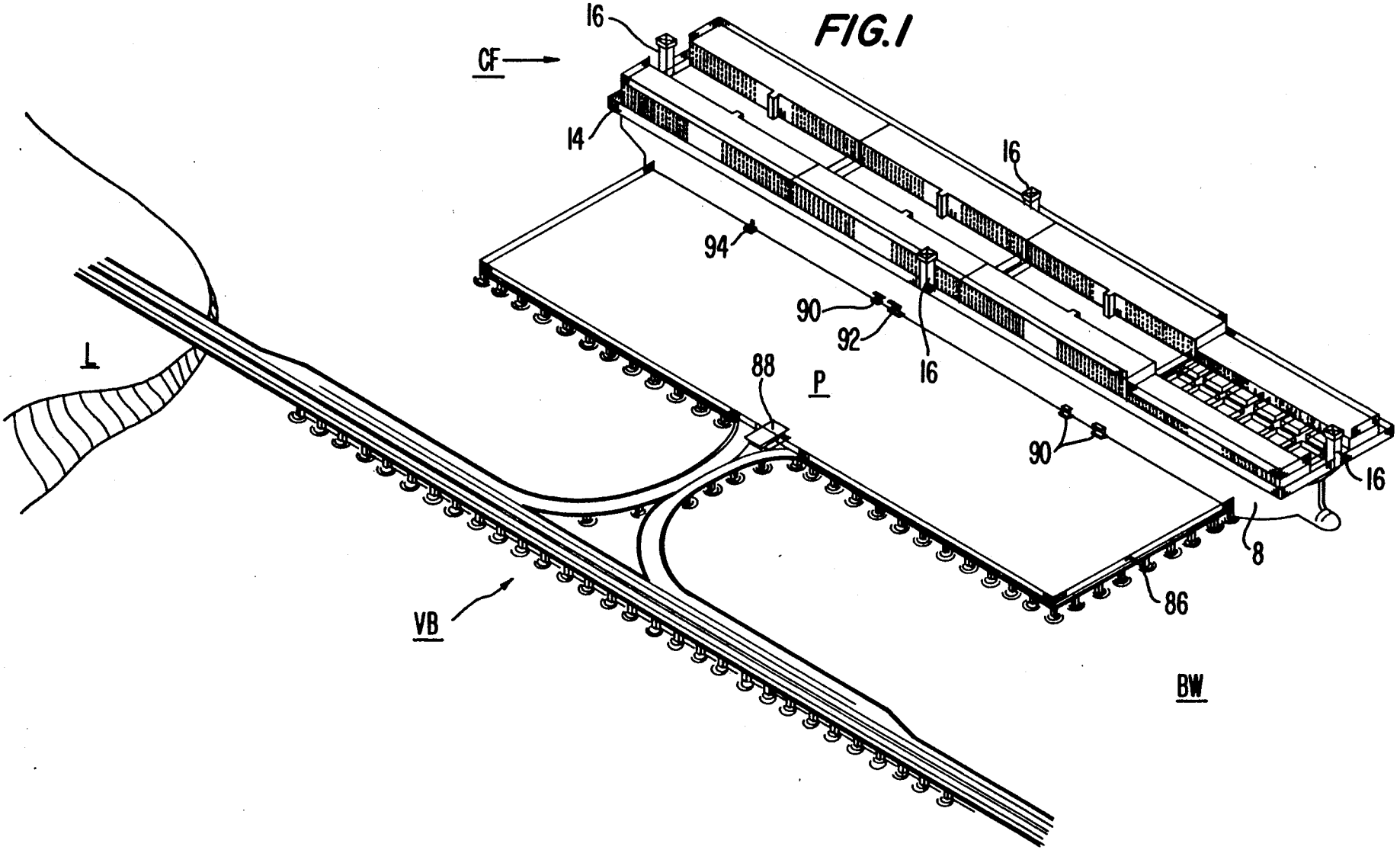
FIG. 1 is a perspective view of the water-based correctional facility or system of the present invention.

The present invention is directed to a water-based correctional facility CF surrounded by a body of water BW as shown in FIG. 1. The correctional system of the present invention preferably utilizes a converted used ship or ship hull. The correctional system preferably includes the combination of the correctional facility CF, a water-based pier P and a vehicular bridge VB interconnecting the pier P with land L as shown in FIG. 1. Alternatively, pier P may be located on land at the water's edge.

Figure 2:
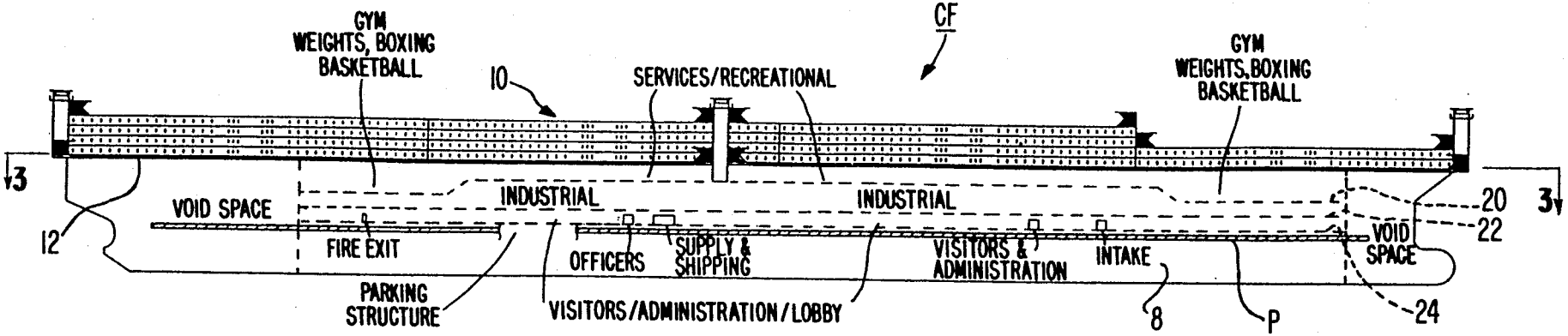
FIG. 2 is a side elevational view of the correctional facility or system of the present invention.
Figure 3:
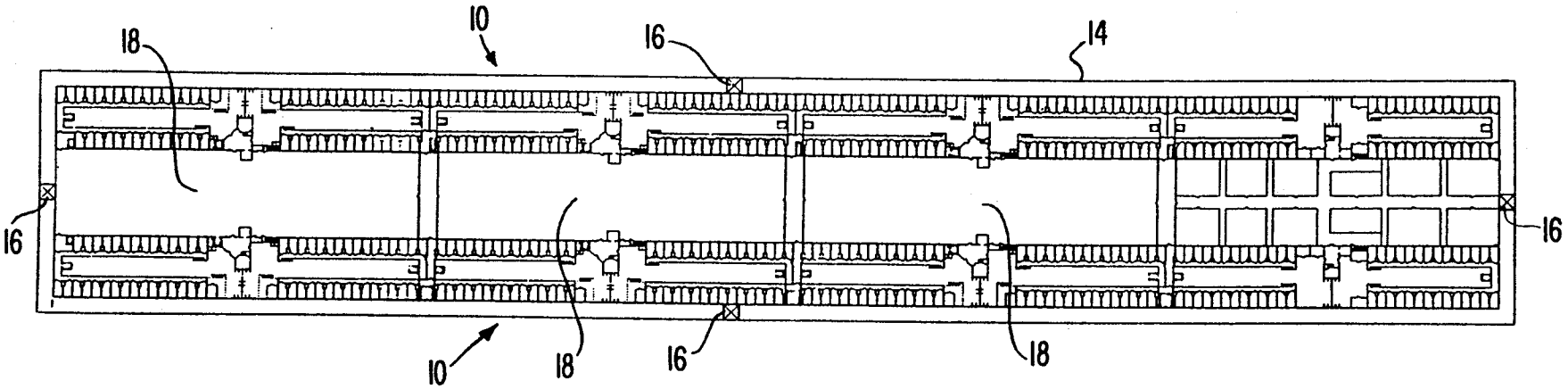
FIG. 3 is a top cross-sectional view through a first level of the multiplicity of prison cells located above the main level of the correctional facility or system.

As shown in FIGS. 2 and 3, a multiplicity of prison cells 10 are positioned on and above a main level 12. More specifically, the embodiment shown in FIG. 2 includes four levels of prison cells stacked one on top of the other for most of the length of the correctional facility CF. A portion of the length of the correctional facility is provided with two levels of maximum security prison cells shown on the right hand side of FIG. 2.

The main level 12 is provided with a security fence 14 encompassing the multiplicity of prison cells 10. A plurality of elevated guard towers 16 extend above and are located around the perimeter of the main level 12 for observing the security fence 14. Preferably, two security fences 14 are provided with the outer fence supported in an outwardly extending manner from the main level 12 (see FIG. 9) for added security.

The multiplicity of prison cells in the embodiment of the correctional facility shown in FIGS. 1–3 are arranged in two rows adjacent either edge of the main deck and extend along the length of the correctional facility. Large expansive areas 18 are provided between the two rows for recreational purposes, assembly of prisoners and for other uses.

Figure 4:
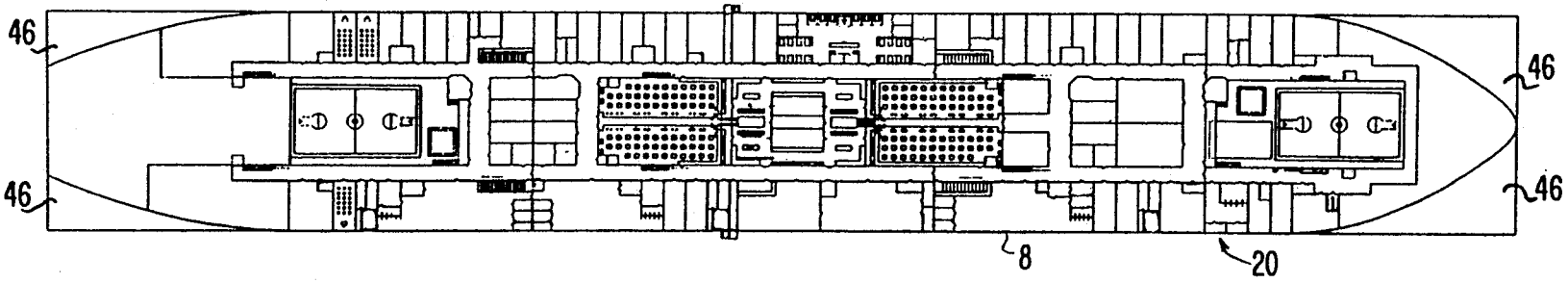
FIG. 4 illustrates one embodiment of a first level located below the main level of the correctional facility or system.

An embodiment of the correctional facility of the present invention involves three levels 20, 22, 24 located below the main level 12 as shown in FIGS. 4–6 and 9. The first level 20, illustrated in FIG. 4, is considered the service/recreational level and includes a number of facilities including a library, vocational training rooms, classrooms, exam rooms, commissary rooms, program manager office, assistant warden office, guard rooms, infirmary, pharmacy, indoor activity areas, visitation areas, staff dining rooms, staff lounge, non-contact visiting rooms, janitor supply rooms, linen supply rooms, indoor exercise rooms, unit control rooms, and a pair of gymnasiums including basketball courts, weights and boxing areas.

Figure 5:
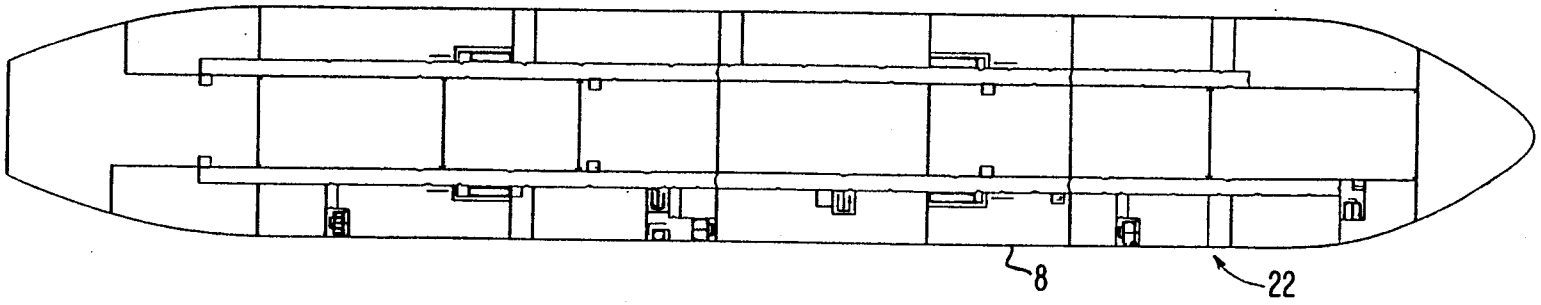
FIG. 5 illustrates an embodiment of a second level located below the main level of the correctional facility or system.

The second level 22 located below the main level 12, illustrated in FIG. 5, is considered the industrial level and includes a plurality of industrial areas, fan rooms for circulating air through the correctional facility, a boiler room, an electrical generator room, switchboard and load center rooms, etc.

Figure 6:
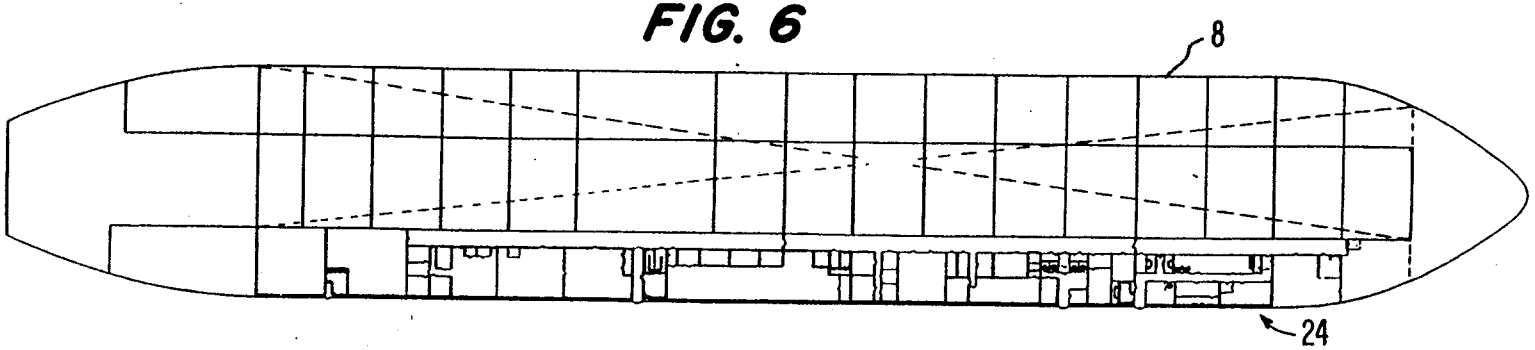
FIG. 6 illustrates an embodiment of a third level located below the main level of the correctional facility or system.

A third level 24 located below the main level 12, illustrated in FIG. 6, is considered the administration level and includes a super control room, officer roll call room, officers lounge, general warehouse, staff training classrooms, accounting and bookkeeping room, personnel manager room, clerical/records work room, visitor storage room, rest rooms, waiting area, warden's office, conference room, group holding room, personal property storage room, valuable storage room, inmate supervision room, clothing issue room, and pump rooms.

CONSTRUCTION OF THE CORRECTIONAL FACILITY

The correctional facility of the present invention may be built from scratch having a lower portion that is equivalent in structure and construction to a ship hull so as to be water tight. However, the economic factors involved dictate the conversion of a used ship or ship hull into the correctional facility. Used ship hulls such as oil tankers have become available because of the world-wide oil shipping depression.

Figure 7:
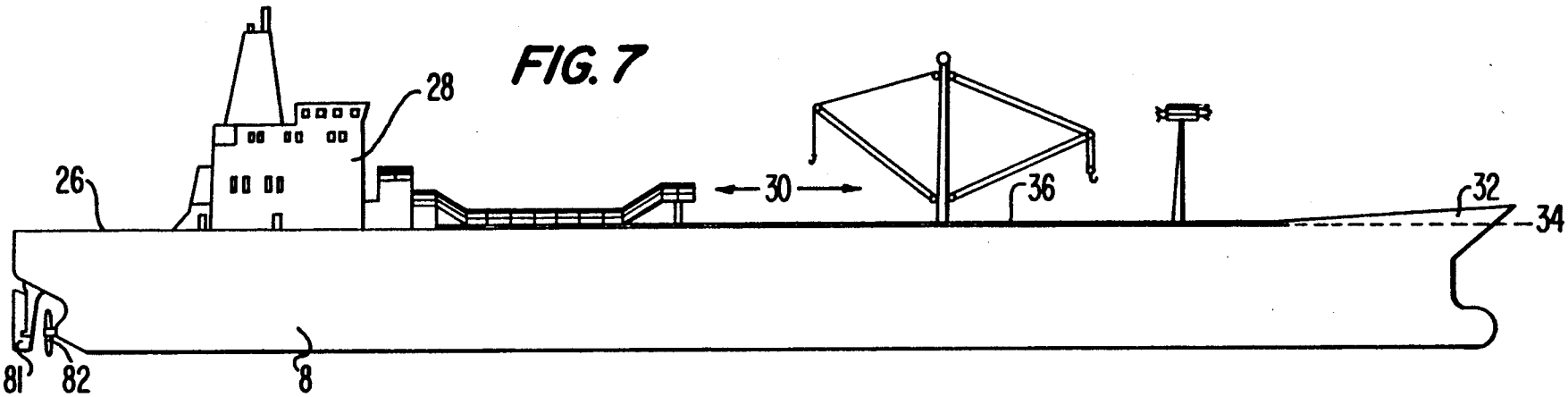
FIG. 7 is a side elevational view of an oil tanker before conversion into the correctional facility or system of the present invention.

Used oil tankers are particularly well suited for conversion into the correctional facility of the present invention due to their availability and the lack of substantial superstructure located above the main deck. As shown in FIG. 7, a typical oil tanker is depicted showing a main deck 26 with superstructure 28 and machinery 30 including cranes, lighting, walkways, fire fighting equipment, etc. extending above the main deck 26. Also, most all ships have a sheer, such as sheer 32, depicted in FIG. 7 to increase the height of the bow relative to the water line to prevent sea water from breaking over the bow of the ship during operation in heavy seas.

During construction of the correctional facility of the present invention from a new hull that has not yet been provided with superstructure and machinery, a flat main level can be constructed of steel plate at approximately the level of a typical main deck on which the multiplicity of prison cells will then be added. However, the conversion of a completed ship into the correctional facility of the present invention requires the removal of the superstructure, such as shown at 28, and machinery, such as shown at 30. Further, the sheer 32, as shown in FIG. 7 should be removed along dotted line 34 to provide a flat bow main level portion along the length of the correctional facility. Alternatively, the sheer 32 is not removed and a leveling means described below provides a flat main level portion at the previously existing bow.

After the removal of the superstructure 28, a flat main level portion 38 is achieved. At the other end of the correctional facility, a flat main level portion 40 results after removal of sheer 32. After the removal of the machinery 30 and the provision of leveling means, as described below, a flat main level portion 44 is provided. The flat main level portions 38, 40, 44 define the main level 12.

Figure 8:
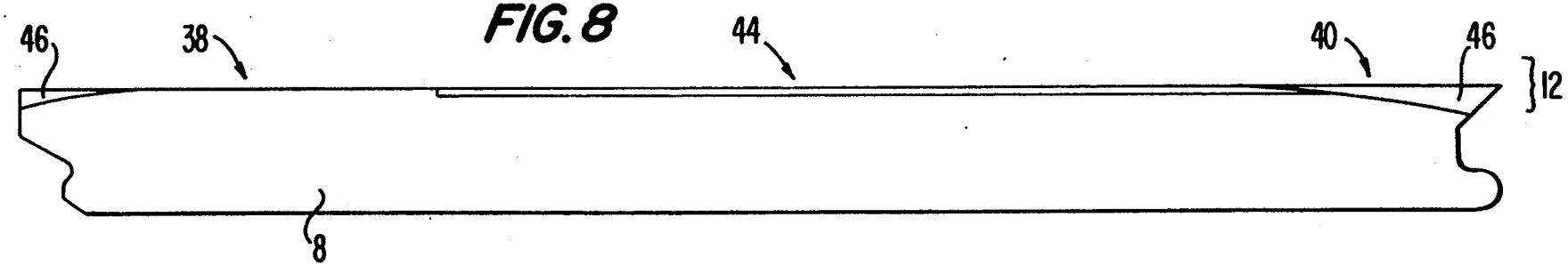
FIG. 8 is a side elevational view of the oil tanker partly converted into the correctional facility or system of the present invention.

Preferably, the main level 12 is constructed so as to be rectangular shaped, as shown in FIG. 3, to provide the maximum amount of usable space. To make the main level 12 rectangular in shape, sponsons 46 are provided at the four corners of the correctional facility as shown in FIGS. 4 and 8.

Figure 9:
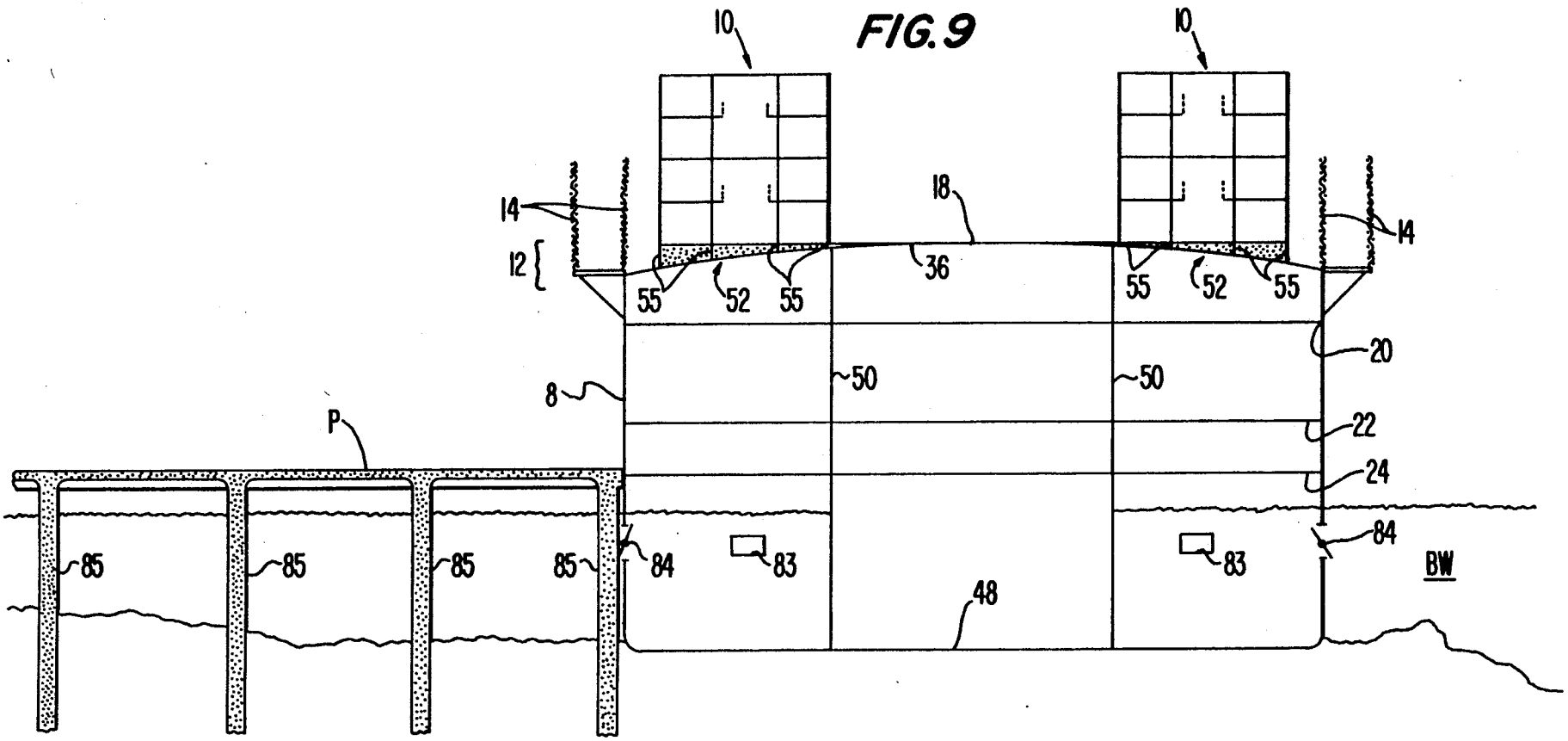
FIG. 9 is a cross-sectional view through the correctional facility or system of the present invention, and a water-based pier positioned adjacent thereto.

FIG. 9 shows a cross-sectional view of the correctional facility having a substantially flat bottom 48 in contact with the bottom B of a body of water BW. The main level 12 is constructed from the previously existing cambered steel deck 36 (of the oil tanker) having leveling means 52 to provide a flat main level 12 on which the multiplicity of prison cells 10 are constructed.

Figure 10:
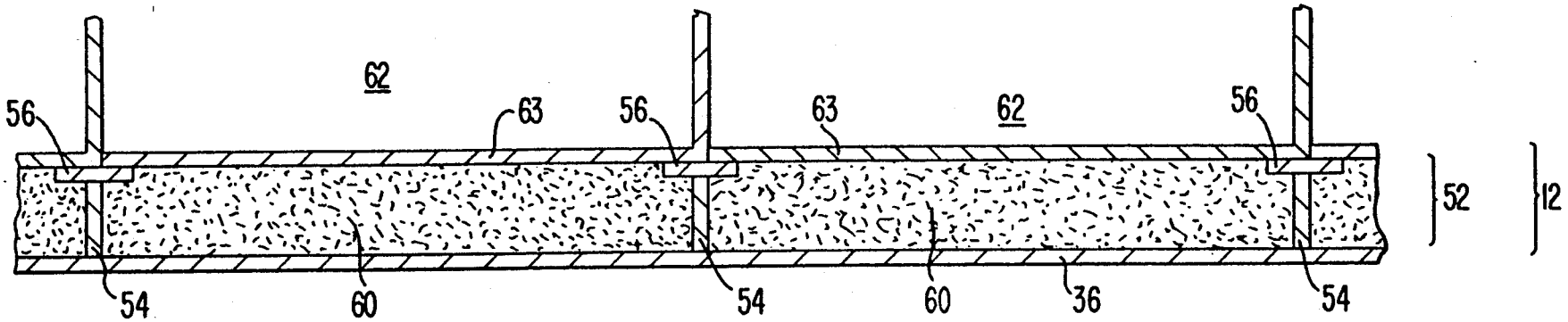
FIG. 10 is a partial cross-sectional view in the longitudinal direction of the correctional facility or system illustrating the construction of one embodiment of the main level.
Figure 11:
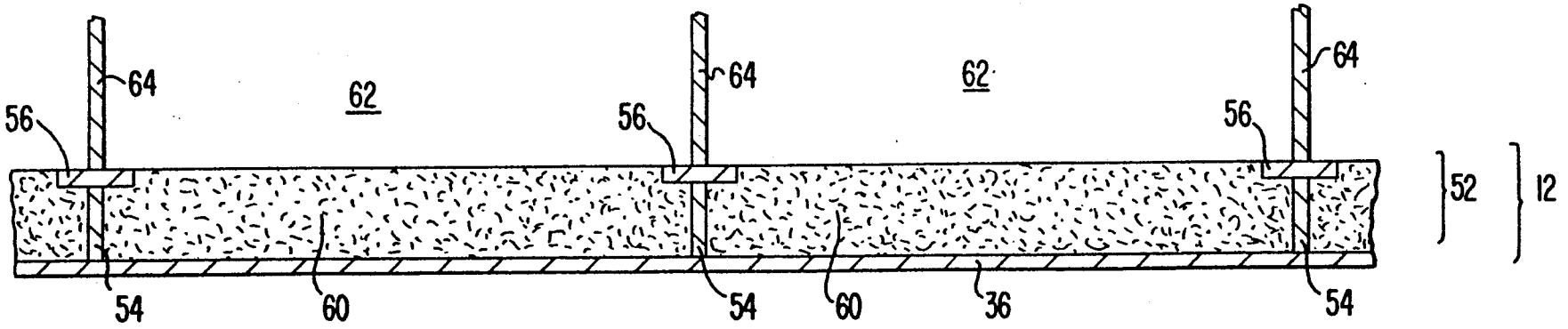
FIG. 11 is a cross-sectional view along the length of the correctional facility or system illustrating another embodiment of the main level.

Two preferred embodiments of the leveling means 52 are illustrated in FIG. 9 and FIGS. 10 and 11. FIGS. 10 and 11 are partially cross-sectional views of the main level 12 along the length of the correctional facility. The leveling means 52 is constructed by welding a plurality of vertical transverse steel plate partitions 54 and vertical longitudinal steel plate partitions 55 (FIG. 9) to the upper surface of the cambered steel deck 36 forming a grid pattern of partitions. Steel cap plates 56 are then welded to the top of each vertical partition. A layer of filler 60 such as concrete is provided in each grid to the level of the upper surface of the cap plate 56. In the embodiment shown in FIG. 10, prison cell units 62 having steel plate floors 63 are then positioned and welded in place on top of cap plates 56. The cap plates 56 allow for variations in the dimensions of the prison cell units 62. The layer of filler 60 is provided to eliminate void spaces underneath the first layer of prison cell units 62 to prevent the nesting of rodents and the escape of prisoners therethrough.

In the embodiment of the leveling means 52 shown in FIG. 11, a plurality of vertical prison cell plates 64 serving as walls of prison cell units 62 are welded on top of cap plates 56. The top surface of the filler 60 serves as flooring for the first level of prison cells of the multiplicity of prison cells 10.

Figure 13:
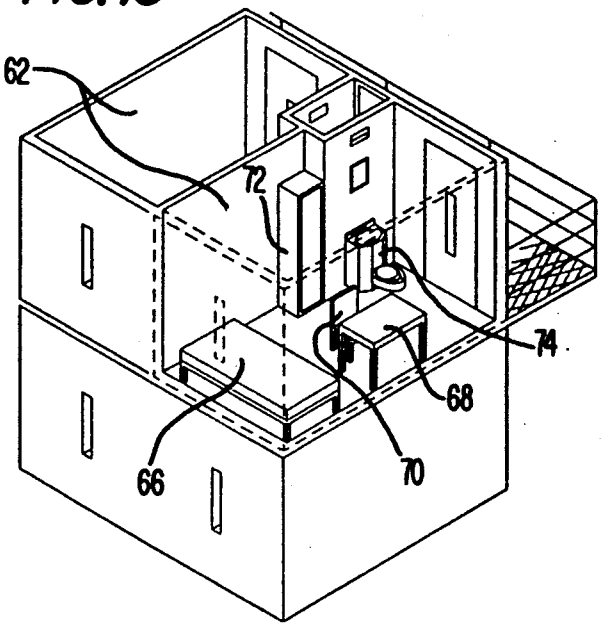
FIG. 13 is a perspective view of a pair of adjacent prison cells depicting the details of the facilities provided therein.
Figure 14:
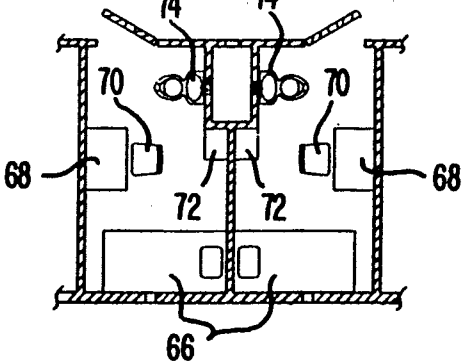
FIG. 14 is a top cross-sectional view through a pair of adjacent prison cells illustrating their arrangement.
Figure 12:
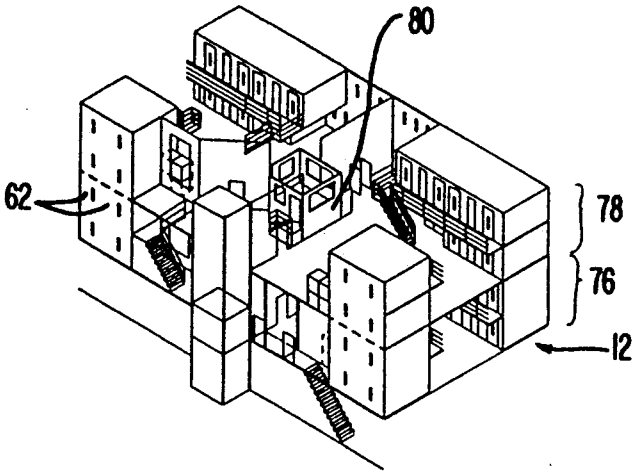
FIG. 12 illustrates an embodiment of the arrangement of some of the multiplicity of prison cells located above the main level of the correctional facility or system.

The details and arrangement of the prison cell units 62 are shown in FIGS. 12–14. Each prison cell unit 62 includes a bed 66, desk 68, chair 70, locker 72 and combined commode and sink 74. Preferably, the prison cell units 62 are constructed as modular units that are prefurnished before being placed on or above the main deck of the correctional facility during construction.

FIG. 12 illustrates a preferred arrangement of prison cell units 62 forming a portion of the multiplicity of prison cells 10. The prison cell units 62 are stacked to provide a first main prison cell level 76 and a second main prison cell level 78. Each main prison cell level is provided with a control room 80 for monitoring and controlling the movement of prisoners within the main prison cell levels and between the main prison cell levels and level 20 below.

CONVERSION OF SHIP OR HULL INTO THE CORRECTIONAL FACILITY

The correctional facility or system of the present invention is generally converted from a used ship or ship hull at a shipbuilding yard. Construction of the correctional facility begins by removal of the superstructure 28 and machinery including piping, mooring and deck machinery 30 down to the bare main deck. Machinery in the engine room, cargo machinery and piping below the main level are removed as economy dictates based on the salvage value or as the particular arrangement of the correctional facility dictates.

The rudder 81 (FIGS. 7 and 8) is removed to reduce the susceptibility of the correctional facility to currents during operation of the facility. Further, propeller 82 and its tail shaft (not shown) are removed and blanked off to eliminate potential leakage, to reduce galvanic corrosion between the propeller 82 and hull 8 and to recoup the salvage value of the propeller 82.

Openings are cut through the main level 12 to provide access to the interior of the hull 8. Parts, and in some cases, all of certain frames, transverse and longitudinal bulkheads are removed as dictated by the specific arrangement desired. In an actual contemplated example, the ship considered was a large oil tanker 347.5 meters long overall, 51.82 meters in breadth and 28.42 meters in depth. The oil tanker included six full-width and one partial width water-tight transverse bulkheads; a engine room cofferdam; several swash bulkheads, and two longitudinal bulkheads. The longitudinal bulkheads (similar to bulkheads 50 in FIG. 9) are retained throughout with access openings provided as necessary therethrough.

Levels below the main level are added to form the various levels described above and shown in FIGS. 2 and 4–6 including a first level 20 for recreation and service, second level 22 for industrial/vocational training areas; and a third level 24 (ground level) for administration, visiting areas and ingress and egress of people and supplies. As shown in FIG. 2, the first level 20 actually is a bi-level deck for providing sufficient height to accommodate two gymnasiums, one at each end of the correctional facility. Several of the transverse bulkheads are retained virtually intact except for provisions for necessary access openings. Many of the web frames are left intact as divisions between smaller spaces. All such bulkheads and frames have surfaces prepared or treated commensurate with their new use.

The second level 22 or industrial level provides room for prison industries. It also has spaces for heating and ventilating equipment, and for distributing electrical power from a shore utility. Provision is made for emergency electricity generation. Further, the transverse bulkheads are retained on this level, but most of the frames are removed.

The third level 24 or administration level utilizes only one side of the hull outboard of one of the longitudinal bulkheads. The remaining space could be used for additional purposes, if desired. This level contains offices and spaces for administrative functions, store rooms, and administration space. It also contains pump rooms for transferring sewage to local sewage systems on shore.

The bottom of the ship is prepared for free flooding and grounding. Calculations are made of the volume of the hull required to be flooded to keep the structure on the bottom in all conditions of weather, currents, tides, waves, etc. that may be expected at the particular water-based site. Openings 83 (FIG. 9) are made in the transverse bulkheads so that the water level within the sides of the hull when the ship is grounded will be the same as the level of the body of water in which the correctional facility is grounded. Valves 84 are installed in the side of the hull below the floating water line to allow flooding of this space. For example, four 1.25-meter butterfly valves may be used, two on either side.

The steel structure that will be in contact with water is protected by conventional methods to prevent corrosion. Where the water is salt water, for example, this may require a system with an inorganic zinc silicate primer and three applications of an epoxy topcoat, and aluminum anodes to prevent galvanic corrosion. Such a system is estimated to provide a life of at least seventy-five years for the facility. That is, the basic structure and integrity would be maintained for this length of time, though the flooded bottom may not remain water tight.

At some point in the construction of the correctional facility, which would probably be after the internal "hull" work is essentially complete, the "topside" work would then be done. The main deck would be modified to eliminate camber and sheer by providing leveling means as discussed above. Sponsons are then added at each corner of the hull and then prison cells would be installed along with plumbing, ventilation, electrical and other distributive systems. The leveling means cooperates with the sponsons for providing a substantially flat rectangular main level 12. Security fencing, guard towers and a perimeter walkway would then be erected.

The prison cells can be of any configuration. FIGS. 1 and 2 show one large section of cells consisting of four tiers of cells for regular prisons and a smaller section of two tiers for maximum security prisoners. A guard room may be provided for each group of 124 cells with 62 cells on each of two levels. That is, the one guard room has unobstructed viewing of 124 cells on two levels. Each group of 500 cells has an exercise yard.

A steel main level would become too hot under certain weather conditions and could be covered with wood or artificial turf or other means to alleviate this condition. Arrangements could be made to grow natural turf if that were desired.

At the completion of the construction of the prison facility at a shipyard or comparable facility, the correctional facility would then be towed to the water-based site. The bottom of the body of water is prepared ahead of time, as by clearing hard objects, leveling, firming the bottom, etc. as necessary or desirable. The floating correctional facility is maneuvered into place, and the flooding valves opened to sink the facility in place on the bottom. It is desirable that the correctional facility can be refloated for relocation and overhaul purposes.

The correctional facility could be constructed so as to be totally self-supporting, with its own power generation, sewage treatment, waste recycling and water purification capabilities.

WATER-BASED CORRECTIONAL SYSTEM

The correctional system according to the present invention includes a converted ship or ship hull. Preferably, the correctional system includes the water-based correctional facility CF, a water-based pier P positioned adjacent the correctional facility and a vehicular bridge VB. Alternatively, the pier may be located on the edge of land. The details of the correctional facility are described above.

The water-based pier P is supported by pilings 85 as shown in FIG. 9. The pier P is surrounded by a perimeter security means such as a fence 86 and provided with a guard station 88 as shown in FIG. 1. The guard station 88 controls the flow of traffic and pedestrians to and from land L and correctional facility CF. The pier P provides space for parking and outdoor storage and provides access to entrances 90, loading dock 92 and fire exit 94.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A water-based correctional facility, comprising:

a ship hull in contact with a bottom of a body of water;

a main level supported by said hull, said main level including a cambered deck;

a multiplicity of prison cells located above said main level;

leveling means supported by said cambered deck, said leveling means having an upper and lower surface, said lower surface conforming to said cambered deck and said supper surface being substantially flat, said leveling means providing a substantially flat main level portion wherein at least some of said multiplicity of prison cells are at least partially supported on top of said main level portion;

said leveling means being substantially continuous eliminating void spaces below said prison cells along the length and width of said ship; and a perimeter security means encompassing said prison cells for preventing prison inmates from escaping the correctional facility.

2. The correctional facility according to claim 1, including a plurality of elevated guard towers located above said main level.

3. The correctional facility according to claim 1, wherein said leveling means comprises a variable thickness layer of filler having a substantially flat and level upper surface portion.

4. The correctional facility according to claim 1, wherein said upper surface portion provides flooring for a first level of said multiplicity of prison cells.

5. The correctional facility according to claim 1, wherein said leveling means is defined by a built-up steel construction having a substantially flat and level steel main level portion.

6. The correctional facility according to claim 1, wherein said leveling means is defined by a plurality of substantially vertical partitions extending from said cambered steel deck with a layer of concrete therebetween.

7. The correctional facility according to claim 1, including an expansive substantially flat and level surface area located above said main level, said surface area being encompassed by said perimeter security means.

8. The correctional facility according to claim 1, including an expansive substantially flat and level surface area defined as a portion of said main level, said surface area being encompassed by said perimeter security means.

9. The correctional facility according to claim 1, wherein said perimeter security means comprises at least one perimeter security fence.

10. The correctional facility according to claim 9, wherein said fence is supported in an outwardly extending manner from said main level to enhance high security measures.

11. The correctional facility according to claim 1, including at least one level provided within said hull and positioned below said main level for supporting a variety of prison facilities.

12. The correctional facility according to claim 11, including means for controlling prisoner access from above to below said main level so as to provide high security and to thwart prison riots.

13. The correctional facility according to claim 12, wherein said means for controlling prisoner access is a guard station.

14. The correctional facility according to claim 1, including access means between said ship hull and adjoining land for vehicular access to the correctional facility.

15. The correctional facility according to claim 14, including a pier positioned adjacent said ship hull and a vehicular bridge connecting said pier to land.

16. The correctional facility according to claim 15, wherein said pier is water-based.

17. The correctional facility according to claim 15, wherein said pier is at least partially land-based.

18. The correctional facility according to claim 15, wherein said vehicular bridge connects into an interstate highway.

19. The correctional facility according to claim 1, wherein a portion of said hull comprises a flood tank.

20. The correctional facility according to claim 19, wherein said tank is provided with a coating system to prevent corrosion.

21. The correctional facility according to claim 1, including at least one sponson extending from the ship hull for increasing the size of said main level.

22. The correctional facility according to claim 21, including a sponson positioned at each corner of said ship hull for providing a substantially rectangular main level.

23. The correctional facility according to claim 22, wherein said prison cells are arranged in a pair of rows along the length of said main level extending over said sponsons with an expansive substantially flat and level surface area positioned between said rows.

24. The correctional facility according to claim 22, wherein said leveling means comprises a layer of concrete positioned over said cambered steel deck cooperating with each sponson for providing a substantially flat and level rectangular main level.

25. The correctional facility according to claim 21, wherein some of said prison cells are supported by said sponson.

26. A water-based correctional system, comprising:

a converted ship or hull having a multiplicity of prison cells located above a cambered main level surrounded by a perimeter security means for preventing inmates from escaping the correctional facility, a leveling means supported by said cambered main level, said leveling means having an upper and lower surface, said lower surface conforming to said cambered main level and said upper surface being substantially flat, said leveling means providing a substantially flat main level portion wherein at least some of said multiplicity of prison cells are at least partially supported on top of sAid main level portion, said leveling means being substantially continuous eliminating void spaces below the prison cells along the length and width of said ship, said ship being positioned in contact with the bottom of a body of water.

27. The system according to claim 26, including a pier positioned adjacent said ship.

28. The system according to claim 27, including a vehicular bridge connecting said pier to land.

29. The system according to claim 28, including a plurality of elevated guard towers located above said main level.

30. The system according to claim 28, wherein said bridge connects directly by a ramp to an interstate highway.

31. The system according to claim 27, wherein said pier is water-based.

32. The system according to claim 27, wherein said pier is at least partly land-based.

33. The system according to claim 27, including a plurality of elevated guard towers located above said main level.

34. The system according to claim 26, including a plurality of elevated guard towers located above said main level.

35. The system according to claim 26, wherein said leveling means is a variable thickness layer of filler having substantially flat and level surface portions.

36. A method of converting a ship into a water-based correctional facility or system, comprising the steps of:

removing existing structure and machinery located above a main cambered deck of the ship;

installing a leveling means supported by said main cambered deck, said leveling means having an upper and lower surface, said lower surface conforming to said main cambered deck and said upper surface being substantially flat, said leveling means providing a substantially flat main level portion and being substantially continuous eliminating void spaces below said prison cells along the length and width of said ship;

installing a multiplicity of prison cells located upon said flat main level portion;

providing a perimeter security means encompassing said prison cells for preventing prison inmates from escaping the correctional facility; and placing the correctional facility or system in contact with the bottom of a bottom of water.

37. The method according to claim 36, including the step of providing access means extending between the correctional facility and land so that the correctional facility is accessible to land.

38. The method according to claim 37, including the steps of removing rudders, propellers and tail shafts of the ship followed by blanking off existing tail shaft bores through the ship's hull.

39. The method according to claim 36, including the steps of removing rudders, propellers and tail shafts of the ship followed by blanking off existing tail shaft bores through the ship's hull.

40. The method according to claim 36, wherein said leveling means is provided by placing vertical partitions on the existing deck, and pouring followed by leveling a layer of filler over said deck between the partitions for providing substantially flat main level portions.

41. The method according to claim 36, including providing at least one sponson on said ship or hull for increasing the size of said main level.

42. The method according to claim 41, wherein a sponson is provided at each corner of the ship or hull for providing a substantially rectangular shaped main level.

43. The method according to claim 42, wherein said leveling means cooperates with each sponson for providing a substantially flat rectangular main level.

44. The method according to claim 36, wherein said leveling means is provided by building a steel construction having a substantially flat steel main level portion over said existing deck.

45. The method according to claim 36, wherein the correctional facility is placed in contact with the bottom by flooding a lower portion of the correctional facility.

46. The method according to claim 45, including the step of providing a lower portion of the correctional facility with flood valves.

47. The method according to claim 36, including the step of removing the sheer from the bow of the ship.

* * * * *